United States Patent [19]

Strudel

[11] Patent Number: 4,628,712

[45] Date of Patent: Dec. 16, 1986

[54] APPARATUS AND METHOD FOR FEEDING TUBULAR TEXTILE FABRIC THROUGH A TREATMENT RANGE

[75] Inventor: Werner Strudel, Friedrichshafen, Fed. Rep. of Germany

[73] Assignee: Lindauer Dornier Gesellschaft mbH, Lindau, Fed. Rep. of Germany

[21] Appl. No.: 628,664

[22] Filed: Jul. 6, 1984

[30] Foreign Application Priority Data

Jul. 15, 1983 [DE] Fed. Rep. of Germany ..... 3325590

[51] Int. Cl.[4] ..... D06F 29/00

[52] U.S. Cl. ..... 68/13 R; 26/85

[58] Field of Search ..... 68/13 R; 8/151; 26/80, 26/85

[56] References Cited

U.S. PATENT DOCUMENTS

| | | | |
|---|---|---|---|
| 2,591,903 | 4/1952 | Yost | 26/80 |
| 2,668,324 | 2/1954 | Johnson | 26/80 X |
| 2,798,515 | 7/1957 | York | 26/80 X |
| 3,285,446 | 11/1966 | Strickland | 26/80 X |
| 4,269,046 | 5/1981 | Strahm et al. | 26/85 X |

FOREIGN PATENT DOCUMENTS

| | | | |
|---|---|---|---|
| 28696 | 5/1964 | Fed. Rep. of Germany | 26/80 |
| 1801563 | 5/1969 | Fed. Rep. of Germany . | |
| 2848409 | 4/1980 | Fed. Rep. of Germany . | |
| 2940867 | 1/1983 | Fed. Rep. of Germany . | |

*Primary Examiner*—Harvey C. Hornsby
*Assistant Examiner*—Frankie L. Stinson
*Attorney, Agent, or Firm*—W. G. Fasse; D. H. Kane, Jr.

[57] ABSTRACT

A tubular textile fabric is advanced through a treatment range having one or several cylindrical expanders. An inlet roller guides the tubular fabric to the expander in a flat shape, whereupon the expander expands the tubular fabric into a substantially cylindrical shape which is again flattened as it moves toward and over an outlet or discharge roller. In the inlet zone between the inlet roller and the expander and in the outlet zone between the expander and the outlet roller, where the fabric changes from the flat form into the expanded form of said cylindrical shape and vice versa, the fabric is exposed to different stretching forces or differing drafts due to differences in the distances that different portions of the fabric must travel while passing through these zones. These different stretching forces or drafts in the inlet zone are effective in the feed advance direction and are compensated by corresponding stretching forces or drafts in the outlet zone. The compensating stretching forces or drafts are caused by twisting the fabric. The twisting in turn is accomplished in that the plane defined by the inlet roller and the plane defined by the outlet roller enclose an angle, preferably an angle of about 90°, whereby the fabric passes through about a quarter turn from the inlet roller to the outlet roller.

7 Claims, 5 Drawing Figures

APPARATUS AND METHOD FOR FEEDING TUBULAR TEXTILE FABRIC THROUGH A TREATMENT RANGE

FIELD OF THE INVENTION

The invention relates to an apparatus and a method for feeding tubular textile fabric through a treatment range in which the fabric is expanded by at least one cylindrical expander. Upstream of the expander, as viewed in the feed advance direction, the fabric has a first flat shape which is expanded into a substantially cylindrical shape when the fabric travels onto the receiving end of the expander, whereupon the fabric travels along the expander. As the cylindrical shape leaves the discharge end of the expander, the fabric is flattened again into a second flat shape.

DESCRIPTION OF THE PRIOR ART

German Patent Publication (DE-AS) No. 2,848,409 corresponding to U.S. Pat. No. 4,269,046, issued May 26, 1981, describes a cylindrical expander for tubular materials or goods. Such an expander may, for example, be used in a stabilizing unit of a mercerizing range as disclosed in German Patent (DE-PS) No. 2,940,867. Such a stabilization or treatment unit is located in the mercerizing range downstream of the so-called padding machine and also downstream of the air course or air passage. Such a unit is operated continuously for the treatment of the tubular goods. It is the purpose of the cylindrical expanders in such a treatment unit to stabilize the mercerized tubular goods. If a treatment by means of the expanders does not take place, the quality improvements achieved by the mercerization of the goods is lost again.

The above mentioned first flat shape of the tubular fabric is accomplished by lead-in or feed-in devices, for example, a guide roller followed by frustum shaped bodies for aiding in the expanding or spreading of the flat fabric into the substantially cylindrical shape. The mentioned conversion back into the second flat shape is accomplished by discharge devices also including frustum shaped discharge or run-out bodies and spring biased flattening blades, and a discharge roller which assures the flattening of the cylindrical shape of the goods or fabric downstream of the expander as viewed in the feed advance direction.

The cylindrical expander has the advantage that it does not cause any bow markings in the tubular fabric because the fabric hugs the expander around its entire circumference. Contrary thereto, so-called flat expanders have the disadvantage that they cause markings in the goods because the goods are contacted only by the skids or runners of the flat expander, thereby causing the so-called bow markings which may reduce the value of the goods.

The above mentioned German Patent Publication (DE-AS) No. 2,848,409 describes in detail the advantages and differences between the cylindrical expanders and the flat expanders.

However, undesirable distensions or stretchings and draughts or drafts may occur in the goods during treatment of the tubular fabric on cylindrical expanders. Such distensions or drafts may be alleviated somewhat by rather expensive measures. A draft in the goods may be caused by the fact that the distances from points along the lead-in guide roller to corresponding points around the lead-in end of the cylindrical portion of the cylindrical expander are different. Hence, different points in the tubular fabric must travel along these different distances in the lead-in zone between the lead-in guide roller and the lead-in end of the cylindrical expander. The same conditions are present in the outlet zone between the cylindrical discharge end of the expander and an outlet or discharge guide roller. Such conditions are also present with regard to any conical inlet bodies in the inlet zone and with regard to any conical outlet bodies in the outlet zone. Further, the effects of these different distances are the more pronounced the smaller the spacing is, in the direction of the longitudinal expander axis, between the respective guide roller and the adjacent cylindrical expander end. More specifically, the distances between the center of the guide roller and the corresponding points at the top and bottom of the adjacent expander end are larger than the distances between the ends of the guide roller and the corresponding points at the sides of the adjacent expander end. These differing distances expose the tubular fabric or hose to different stretching forces which in turn cause distensions and drafts in the fabric. These distensions and drafts are the more pronounced the smaller the spacing is, in the axial direction, between the guide roller and the expander.

Such drafts or distensions occur in the inlet zone as well as in the outlet zone. Further, for all practical purposes more than one expander is generally used so that in a treatment range as disclosed in the above mentioned German Patent Publication (DE-AS) No. 2,848,409 usually several expanders are arranged in sequence and the tubular goods travel over these several expanders in sequence. In such a system the axis of the lead-in guide roller upstream of the expander and the axis of the outlet guide roller downstream of the expander are arranged in parallel to each other and this is true for each expander. As a result, the distensions and drafts are accumulated, not only in the inlet and outlet zone of one expander, rather, the undesirable effect is multiplied by the number of expanders employed in a treatment range heretofore.

As mentioned, the undesirable effectiveness of the different distances depends on the spacing between the guide rollers and the adjacent end of the expander. Therefore, it would be possible to reduce the distensions and drafts by making these spacings sufficiently large, however, such enlargement would substantially increase the dimension of the entire system, for example, the height of the system may become too large for all practical purposes. Therefore, such increase in the overall system dimensions is not desired and in many instances cannot be accomplished in practice.

OBJECTS OF THE INVENTION

In view of the above, it is the aim of the invention to achieve the following objects singly or in combination:

to construct a treatment range equipped with cylindrical expanders in such a way that the tubular textile fabric or hose is substantially free of the mentioned distensions and drafts after the treatment;

to avoid the mentioned distensions and drafts while still assuring the compact arrangement of all the components of a treatment range relative to each other;

to provide a method for the avoidance or substantial avoidance of the mentioned distensions and drafts which is applicable to any number of cylindrical expanders in a treatment system or range; and to distribute any remaining longitudinal stretching forces as uniformly as possible around the circumference of the tubular fabric or hose as it travels through a treatment range.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

FIGS. 1, 2, 3, and 4 illustrate, in a substantially simplified manner, four views or sections of the same treatment unit or range comprising two vertically arranged cylindrical expanders B1 and B2. These expanders B1 and B2 are of conventional construction, for example, as illustrated in German Patent Publication (DE-AS) No. 2,848,409 mentioned above. Therefore, a detailed description of the expanders is not necessary. The treatment range shown in FIGS. 1, 2, 3, and 4 will be described in conjunction with reference to these figures.

Figure 1:
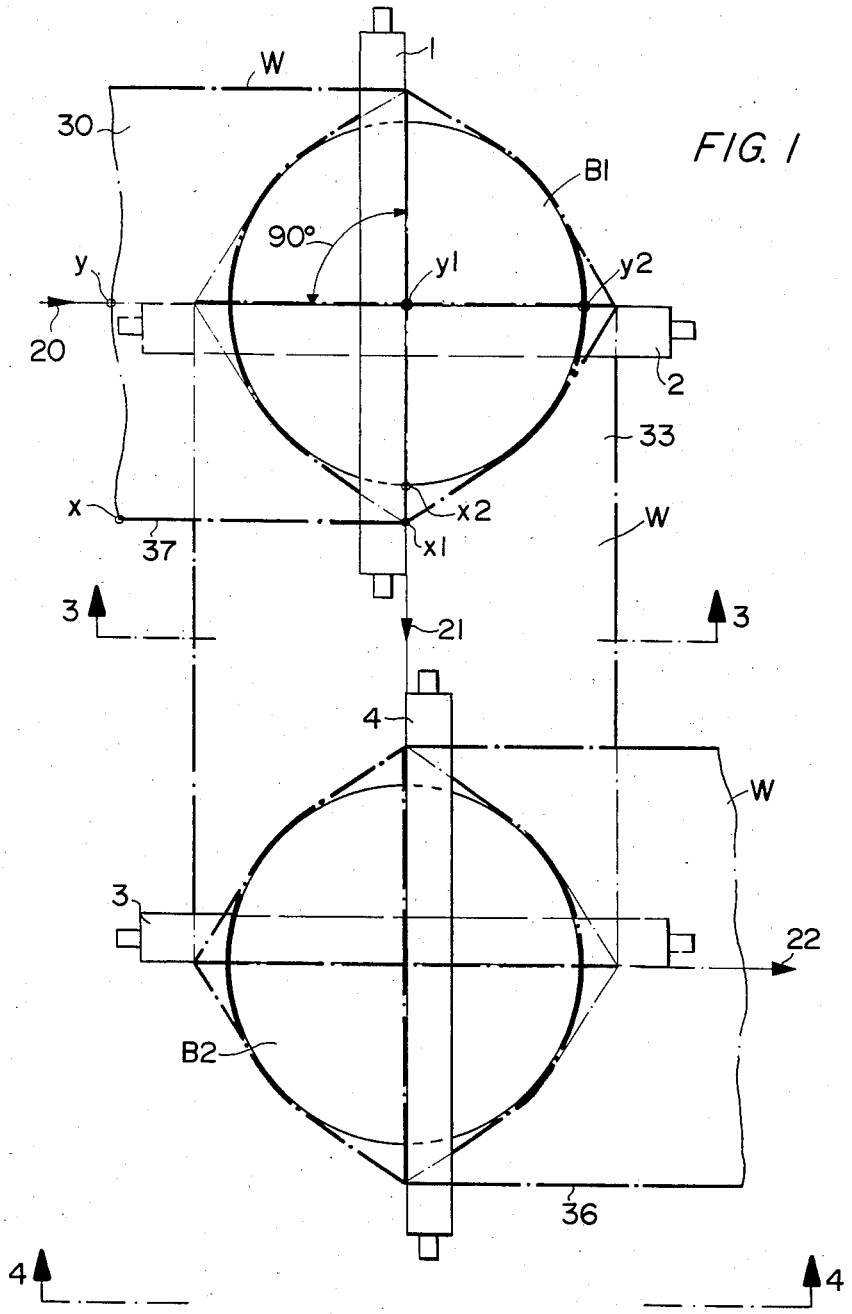
FIG. 1 is a schematic illustration of two cylindrical expanders each having a vertical axis with both axes extending in parallel to each other and as viewed in the direction indicated by the arrows 1—1 in FIG. 3.
Figure 2:
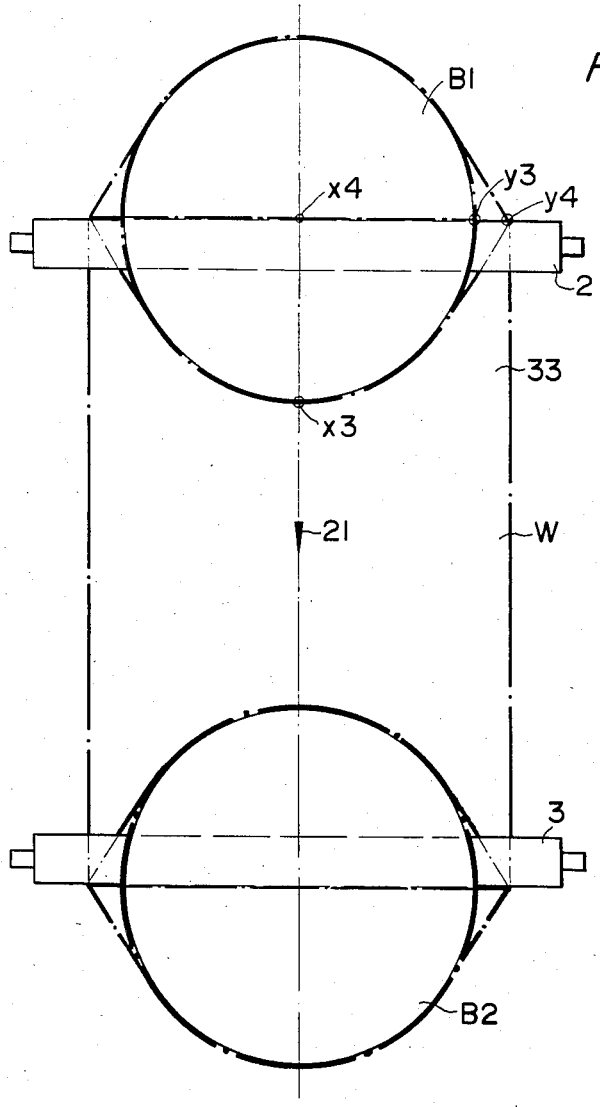
FIG. 2 is a sectional view along section line 2—2 in FIG. 3.
Figure 3:
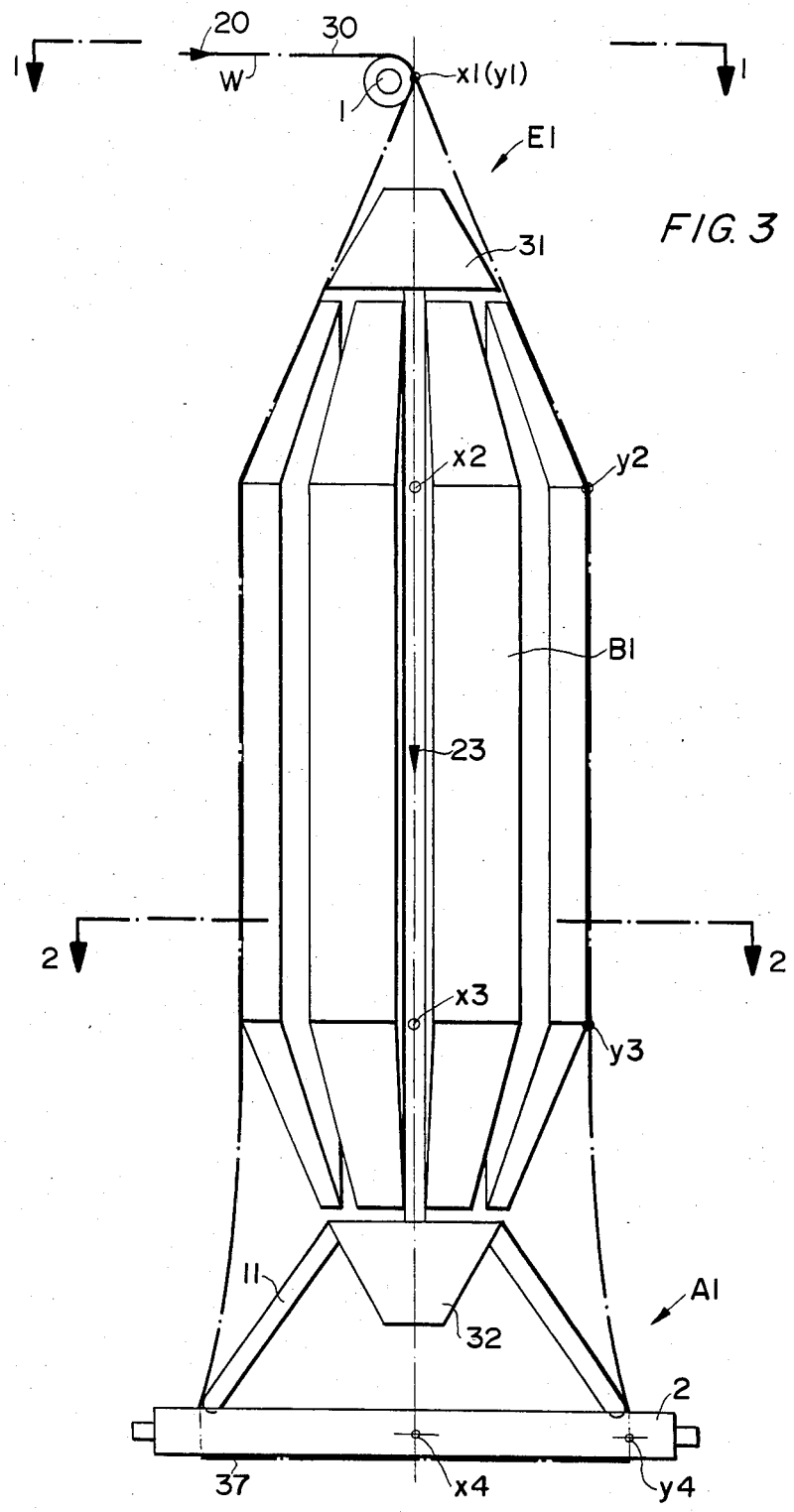
FIG. 3 is a side view in the direction toward the plane indicated by arrows 3—3 in FIG. 1.

A tubular textile fabric or hose W moves in the direction of the arrow 20 as a first flat shape 30 onto a first feed-in means in the form of a first guide roller 1 which defines a feed-in first plane coinciding with the flat shape 30 extending perpendicularly to the sheet of the drawing of FIG. 3, but extending in the sheet of the drawing of FIG. 1. The fabric or hose W is shown in dash-dotted lines. The arrow 20 indicates the feed advance direction. The feed-in end 31 of the first cylindrical expander B1 expands the fabric or hose W downstream of the first guide roller 1 into a substantially cylindrical shape in which the fabric or hose W travels vertically downwardly along the first expander B1 as indicated by the arrow 23 in FIG. 3. The outlet end 32 of the first expander B1 with its spreading blades 11 guides the fabric W onto discharge means in the form of a second guide roller 2 as shown in FIGS. 1, 2, and 3. The second guide roller 2 forms a second flat shape 33 of the fabric W downstream of the roller 2. The second flat shape 33 travels in the direction of the arrow 21 toward a third lead-in guide roller 3 supplying the flat shape of the fabric or hose W to the inlet end 34 of the second cylindrical expander B2 which converts the flat shape 33 again into a cylindrical shape which travels vertically upwardly along the second expander B2 as indicated by the arrow 24 in FIG. 4, whereupon the discharge end 35 of the second expander B2 leads the fabric toward a further discharge roller 4 which again flattens the fabric into a further flat shape 36 as it leaves the treatment range as indicated by the arrow 22 in FIGS. 1 and 4. Thus, the discharge feed-out or guide rollers 2 and 4 define second feed-out planes coinciding with the flat shapes 33 and 36 of the fabric W downstream of the respective expander B1 or B2 as viewed in the feed advance direction. Each of the expanders B1 and B2 has a longitudinal axis extending perpendicularly to the plane defined by the sheet of the drawing of FIG. 1. The angular position of the feed-in guide roller 1 and of the feed-out or discharge guide roller 2 determines, according to the invention, the twisting of the tubular textile fabric out of the first feed-in plane 30 and into the second feed-out plane 33 for compensating by the twisting, any stretching or draft caused in the fabric when it travels onto and off the respective expander, for example B1. Incidentally, the feed advance for the fabric W may be provided by conventionally driving any one or more of the guide rollers 1, 2, 3, and/or 4.

Figure 4:
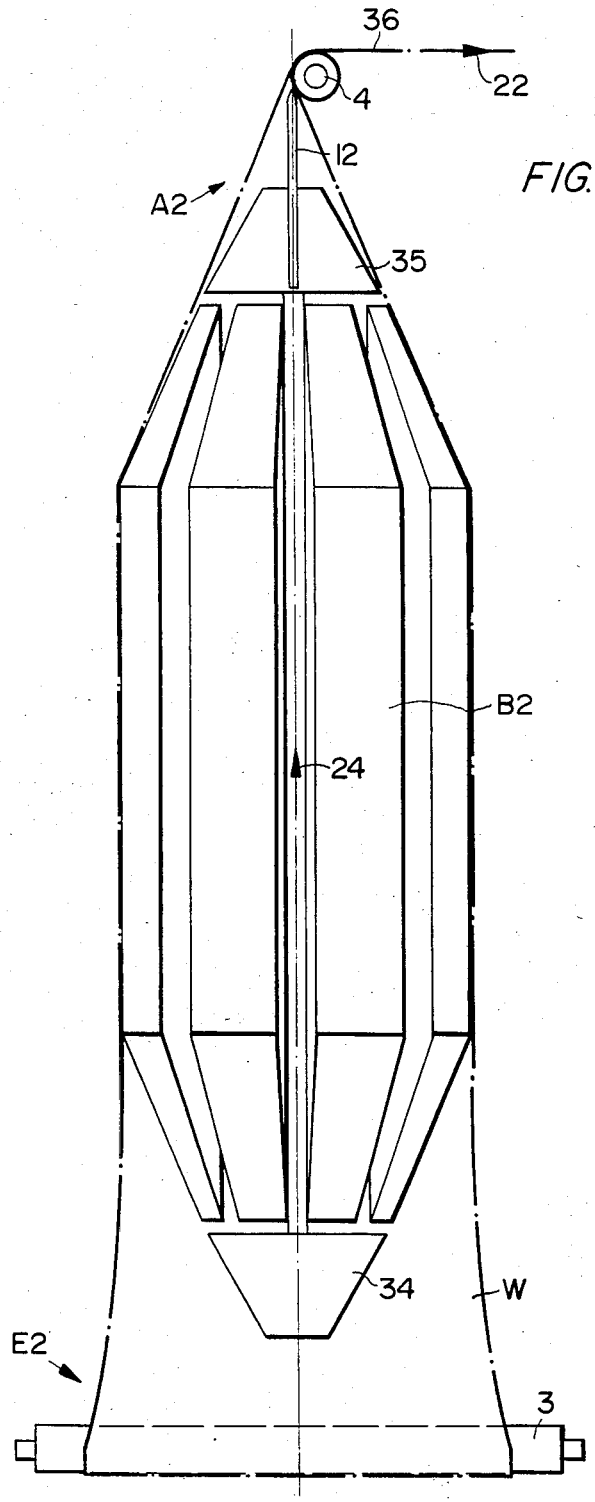
FIG. 4 is a side view similar to that of FIG. 3, however, showing a view in the direction toward the plane indicated by the arrows 4—4 in FIG. 1.

A first inlet zone E1 is formed between the first inlet guide roller 1 and the cylindrical portion of the first expander B1. A first outlet zone A1 is formed between the cylindrical portion of the expander B1 and the discharge or outlet guide roller 2. Similarly, a further inlet zone E2 is formed between the inlet guide roller 3 and the cylindrical portion of the second expander B2. A further outlet or discharge zone A2 is formed between the cylindrical portion of the second expander B2 and the discharge or outlet guide roller 4. These inlet and outlet zones may comprise conventional conical members forming part of the respective expander B1, B2. Additionally, the outlet zones A1 and A2 comprise spreader blades 11 and 12 as shown in FIGS. 3 and 4. These spreader blades 11 and 12 bear from the inside against the tubular fabric or hose W, thereby assuring the desired proper flattening of the fabric or hose W.

The above mentioned twisting of the fabric according to the invention is accomplished by enclosing an angle between the first feed-in roller 1 and the second discharge roller or feed-out roller 2. As shown in FIG. 1, according to the invention, the twisting angle between the first feed-in roller 1 leading into the inlet zone E1 of the expander B1, and the second feed-out or discharge roller 2 downstream of the discharge or outlet zone A1 of the expander B1 is, for example, 90° so that the twisting of the fabric around the longitudinal expander axis of the expander B1 amounts to about a quarter turn. As seen in FIG. 1 the feed-in direction 20 extends across the discharge or feed-out direction 21 or vice versa, whereby the above mentioned distensions or drafts are compensated or substantially eliminated, which is an important advantage of this type of feeding according to the invention.

Incidentally, in FIG. 3 the discharge direction out of the first outlet or discharge zone A1 is in the direction perpendicularly to the plane defined by the sheet of FIG. 3, that is, toward the viewer.

With reference to FIGS. 1, 2 and 3 it will now be explained how the above mentioned distensions or stretching and the drafts occur as the fabric travels from the inlet zone E1 to the outlet zone A1 of the expander B1. FIG. 1 shows a point x located in the bow or edge 37 of the fabric W when it is still flat upstream of the first guide roller 1. The point x reaches location x1 when it contacts the first guide roller 1. Point x then travels to the location x2 on the circumference at the beginning of the cylindrical portion of the expander B1, please see FIG. 3. As the travel continues, the point X reaches the location x3 at the end of the cylindrical portion of the expander B1, whereupon it travels to the location x4 when the fabric again contacts the feed-out or discharge guide roller 2. By viewing FIGS. 1 and 2 together it will be seen that point x started out in the bow or edge 37 at x1, but ended up in the center of the fabric W at x4.

Analogously to the travel of a point x as described above, a point y located in the center of the still flat fabric W as shown in FIG. 1, travels to the location y1 in the center of the guide roller 1 in the inlet zone E1. From the location y1 the point y keeps moving to locations y2 and y3 as shown in FIGS. 1 and 2 and on to location y4 as shown in FIGS. 2 and 3. Thus, point y, which was initially located in the center of the fabric, is now located at the edge or bow of the fabric when it contacts the lead-out or discharge roller 2 in the discharge zone A1 as shown in FIG. 3.

The distance y1 to y2 in the inlet zone E1 is longer than the distance x1 to x2. As a result, the point y of the hose or tubular fabric is subject to forces causing a draft in the fabric. On the other hand, in the discharge zone A1 the distance x3 to x4 is larger than the distance y3 to y4 so that here a draft is caused at the point x. All intermediate points between the discussed points x and y are subject to the same conditions, whereby the values of the drafts along these intermediate points or locations are within the range defined by the extreme values x and y. The foregoing shows that due to the angular twisting of the discharge direction relative to the inlet direction as caused by the position of the guide rollers 1 and 2, the described drafts which as such are unavoidable, compensate each other to a substantial extent.

While a single twisting of the inlet direction relative to the discharge direction of the tubular fabric or hose between the inlet zone E1 and the outlet zone A1 is quite satisfactory in many instances, it may not provide goods completely free of drafts and/or distensions as practical experience has shown. However, the beneficial effect may be multiplied by arranging one or more spreaders B2 in sequence with the spreader B1. As shown in FIGS. 2 and 4, in such an arrangement the tubular fabric W approaches the second expander B2 at the bottom end 34 where the guide roller 3 changes the travel direction vertically upwardly as indicated by the arrow 24 in FIG. 4. Thus, the fabric travels through the inlet zone E2 and is converted again into the flat shape in the outlet zone A2. The spreader blades 12 in the outlet zone A2 have the same purpose as the spreader blades 11 in the outlet zone A1 of the expander B1. The discharge guide roller 4 leads the material in the flat shape 36 to further treatment, for example in a further expander not shown.

As shown in FIG. 1, the expander B1 and the expander B2 are arranged at 90° relative to each other. More specifically, the lead-in guide roller 1 of the expander B1 extends at 90° relative to the lead-in guide roller 3 of the expander B2. Further, the axes of the guide roller 2 of the expander B1 and of the guide roller 3 of the expander B2 extend in parallel to each other. The guide rollers 3 and 4 of the expander B2 extend again at a right angle relative to each other just as the rollers 1 and 2 of the expander B1. Thus, the inlet direction at the top of the expander B1 indicated by the arrow 20 extends in parallel to the outlet direction at the top of the expander B2 as indicated by the arrow 22. However, the tubular fabric at the inlet of the first expander B1 is horizontally spaced from the tubular fabric at the outlet of the expander B2 as best seen in FIG. 1. This spacing between the two fabric portions is determined by the oncenter spacing between the two expanders B1 and B2. All the remarks made above with regard to the expander B1, especially with regard to the occurrence of the localized stretchings and drafts in the tubular fabric and the compensation of these stretchings and drafts are equally applicable to the expander B2.

Figure 5:
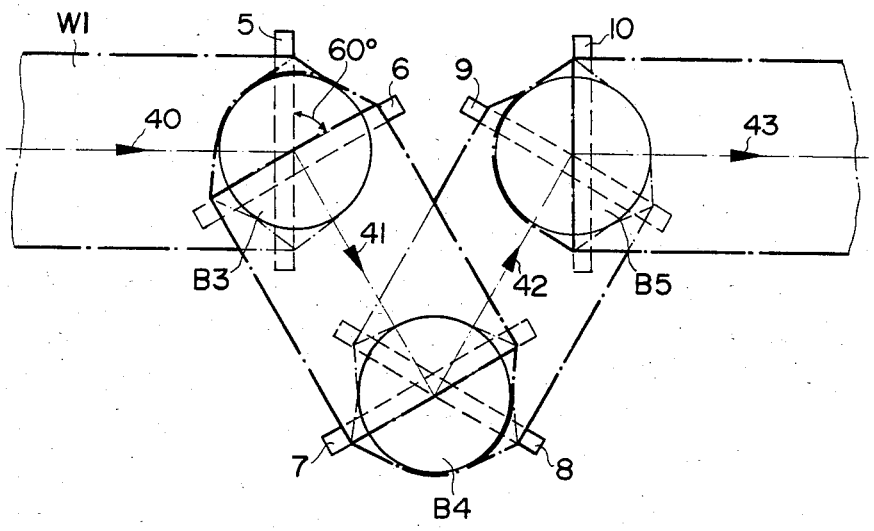
FIG. 5 illustrates a schematic top plan view onto three expanders each having a vertical axis with all three axes extending in parallel to one another.

FIG. 5 illustrates a further embodiment of a treatment range according to the invention. In this embodiment the tubular hose or fabric W1 travels in the feed advance direction indicated by the arrows 40, 41, 42, and 43, and along three expanders B3, B4, and B5. A first lead-in guide roller 5 leads the fabric W1 to the top of the expander B3. The fabric continues in its expanded condition along the expander B3 to the lower guide roller 6 at the lower discharge end of the expander B3, whereby the lower discharge guide roller 6 is arranged at an angle of less than 90° relative to the guide roller 5, for example, at an angle of 60°. The guide roller 6 is arranged in parallel to the lead-in guide roller 7 of the expander B4. The fabric travels upwardly from the inlet guide roller 7 along the expander B4 at the upper output end of which it is guided by the outlet guide roller 8 of the expander B4 to the inlet guide roller 9 of the third expander B5 along which the fabric travels from the top down again toward the discharge guide roller 10 from which the fabric may be withdrawn. The guide rollers 7 and 8 of the expander B4 are also arranged at an angle relative to each other and so are the guide rollers 9 and 10 of the expander B5. The angular displacement may be selected in accordance with particular requirements. Preferably, the angular displacements are the same in each pair of guide rollers, for example, all the displacement angles could be 60° because this type of arrangement is especially space saving and hence compact.

The system shown in FIG. 5 also achieves an excellent compensation of localized distensions or stretchings and localized drafts in the fabric. Another advantage of this arrangement is seen in that the tubular fabric enters the system in the same direction as it leaves the system without a lateral displacement as illustrated in FIG. 1.

The change in the pulling direction as a result of the mentioned twisting of the inlet direction into the discharge direction of the fabric between the inlet and outlet zone of an expander, causes a compensation of the mentioned tension forces and such compensation effect is increased by the number of expanders employed so that a complete compensation may be achieved if desired. It has been found that the drafts which are practically uniformly distributed around the entire circumference of the tubular material, are also uniformly compensated by the present teaching. Further, the compensation achieved is independent of the spacing between the guide rollers and the respective expander. Thus, it is not necessary according to the invention to increase the structural height of such a treatment range or system. The same considerations apply in those systems in which the expanders are arranged horizontally.

Although the invention has been described with reference to specific example embodiments, it will be appreciated, that it is intended, to cover all modifications and equivalents within the scope of the appended claims.

What is claimed is:

1. An apparatus for feeding tubular textile fabric through a treatment range in a given feed advance direction, comprising feed-in means having a first longitudinal axis for passing the tubular textile fabric in a first flat shape into the treatment range in an inlet direction, discharge means having a second longitudinal axis for passing the tubular textile fabric in a second flat shape out of the treatment range in a discharge direction, cylindrical expander means having a third longitudinal axis, a first transition zone (E1) operatively positioned between said feed-in means and said cylindrical expander means, a second transition zone (A1) operatively positioned between said cylindrical expander means and said discharge means, said first transition zone (E1) expanding said first flat shape of the tubular textile fabric into a substantially cylindrical shape, said second transition zone contracting said cylindrical shape toward said discharge means for flattening the substantially cylindrical shape of the fabric back into said second flat shape as the fabric is travelling from said feed-in means to said discharge means, whereby points (x, y) on a line across said first flat shape must travel different distances through said first and second transition zones, thereby causing drafts in the fabric in said first and second transition zones, said feed-in means defining a feed-in first plane for the fabric upstream of said expander means as viewed in said feed advance direction, said discharge means defining a feed-out second plane for the fabric downstream of said expander means as viewed in the feed advance direction, said inlet direction extending perpendicularly to said first longitudinal axis, said discharge direction extending perpendicularly to said second longitudinal axis, said first and second longitudinal axes extending perpendicularly to said third longitudinal axis, said first and second longitudinal axes enclosing an angle around said third longitudinal axis of said expander means for twisting said inlet direction into said discharge direction for moving the tubular textile fabric out of said feed-in first plane into said feed-out second plane, whereby a longer draft in one transition zone is correlated with a shorter draft in the other transition zone and vice versa for substantially compensating by said twisting, said drafts caused in the fabric when it travels onto and off said expander means through said first and second transition zones respectively.

2. The apparatus of claim 1, wherein said feed-in means comprise a feed-in roller having a first rotational axis, wherein said discharge means comprise a discharge roller having a second rotational axis, said first and second rotational axes extending at said angle relative to each other.

3. The apparatus of claim 1, wherein said cylindrical expander means comprise a plurality of cylindrical expanders, each of said cylindrical expanders having its respective feed-in means and its respective discharge means defining corresponding run-in and run-out planes forming pairs such that said angle is the same in each pair formed by a run-in plane and a run-out plane.

4. The apparatus of claim 1, wherein said angle is about 90° so that the respective twisting of said fabric between said inlet means and said discharge means amounts to about a quarter turn around said longitudinal axis of said expander means.

5. A method of feeding tubular textile fabric in a feed advance direction through a treatment range, comprising the following steps: feeding said tubular textile fabric in a first flat shape in a first plane into an inlet of the range, expanding said first flat shape downstream of said inlet, as viewed in the feed advance direction, in a first transition zone into a tubular approximately cylindrical shape, contracting the tubular approximately cylindrical shape in a second transition zone back into a second flat shape, said expanding and contracting causing different points (x, y) on a line across said first flat shape to travel different distances in said first and second transition zones thereby causing drafts in said fabric, and simultaneously twisting an inlet direction of fabric travel into an outlet direction of fabric travel so as to feed said second flat shape to an outlet in a second plane enclosing an angle with said first plane, for correlating a longer draft in one transition zone with a shorter draft in the other transition zone and vice versa for substantially compensating by said twisting, said drafts in the fabric.

6. The method of claim 5, wherein said angle enclosed by said first and second planes is about 90°, whereby said twisting results in about a quarter turn of said material between said inlet and said outlet.

7. A system for feeding initally flat tubular textile fabric through a treatment range in its expanded tubular form, comprising at least one cylindrical expander, first guide means arranged for cooperation with an inlet transition zone (E1) of said cylindrical expander and second guide means arranged for cooperation with an outlet transition zone (A1) of said cylindrical expander, said first and second guide means being arranged at an angle relative to each other for twisting an inlet travelling direction of said fabric around a longitudinal axis of said expander into a discharge travelling direction as the fabric travels from said first guide means through said inlet transition zone, over said cylindrical expander through said outlet transition zone to said second guide means, said fabric expanding in said inlet transition zone and contracting in said outlet transition zone, thereby causing different points (x, y) on a line across said initially flat fabric to travel different distances in said inlet and outlet transition zones, said different travel distances causing drafts of different lengths in said fabric, said twisting correlating longer drafts in one transition zone with shorter drafts in the other transition zone and vice versa, whereby said drafts in said fabric are compensated.

* * * * *